US006574899B1

(12) United States Patent
Mostello

(10) Patent No.: US 6,574,899 B1
(45) Date of Patent: Jun. 10, 2003

(54) TRIPOD-MOUNTED COMBINED GUN REST AND ARMREST

(76) Inventor: Thomas Mostello, 224 Broughton Ave., Bloomfield, NJ (US) 07003

( * ) Notice: Subject to any disclaimer, the term of this patent is extended or adjusted under 35 U.S.C. 154(b) by 0 days.

(21) Appl. No.: 10/072,488

(22) Filed: Feb. 7, 2002

(51) Int. Cl.[7] ..... F41A 27/30
(52) U.S. Cl. ..... 42/94
(58) Field of Search ..... 269/87.2; 42/94; 211/64; 224/913; 89/37.01

(56) References Cited

U.S. PATENT DOCUMENTS

| | | | | | |
|---|---|---|---|---|---|
| 3,960,052 | A | * | 6/1976 | Smith et al. | 89/37.04 |
| 4,535,559 | A | * | 8/1985 | Hall | 42/94 |
| 4,790,096 | A | * | 12/1988 | Gibson et al. | 42/94 |
| 4,854,066 | A | * | 8/1989 | Canterbury, Sr. | 42/94 |
| 4,913,391 | A | * | 4/1990 | Klipp | 248/214 |
| 4,967,497 | A | | 11/1990 | Yakscoe | 42/94 |
| 5,070,636 | A | * | 12/1991 | Mueller | 42/94 |
| 5,347,740 | A | | 9/1994 | Rather et al. | 42/94 |
| 5,491,919 | A | | 2/1996 | Rather et al. | 42/94 |
| 5,913,668 | A | | 6/1999 | Messer | 42/94 |
| 5,930,933 | A | | 8/1999 | Schleicher | 42/94 |
| 5,933,999 | A | * | 8/1999 | McClure et al. | 42/94 |
| 5,974,719 | A | | 11/1999 | Simonek | 42/94 |
| 6,044,747 | A | | 4/2000 | Felts | 89/40.06 |
| 6,272,785 | B1 | | 8/2001 | Mika et al. | 42/94 |
| 6,338,218 | B1 | * | 1/2002 | Hegler | 42/94 |

* cited by examiner

*Primary Examiner*—Michael J. Carone
*Assistant Examiner*—Denise J Buckley
(74) *Attorney, Agent, or Firm*—Siegmar Silber, Esq.

(57) ABSTRACT

A combined gun rest and armrest is described which includes an armrest which is attachable to a tripod. The armrest has a pair of elongated slots into which U-shaped gun rests are inserted and are laterally adjusted to support a gun. One of the gun rests is constructed to accommodate the forearm of the gun; and the other, the stock of the gun. The lateral adjustment of the gun rests enables the positioning thereof so as to have the center of gravity of the gun aligned with the tripod connection. Upon placing the gun in the gun rests, the opening between the gun and the armrest enables the marksmen to assume the normal shooting position and provides unencumbered access to the trigger and the area surrounding the trigger. The device is constructed to be compatible with the normal physical range. However, in the cases outside the range, the gun rests may be raised or lowered accordingly. Once adjusted for a particular person and for a particular gun, the settings are readily maintained for future use.

8 Claims, 3 Drawing Sheets

TRIPOD-MOUNTED COMBINED GUN REST AND ARMREST

BACKGROUND OF THE INVENTION

1. Field of the Invention

This invention relates to a device for a sportsman, namely, a combined gun rest and armrest connected to a tripod for supporting the gun and the arm of the sportsman. The tripod on which combined gun rest and armrest is mounted is tiltable and rotatable.

2. Description of the Prior Art

Gun users frequently wait for long periods of time before their target appears and the appearance of the target can often be fleetingly brief. At the moment when precision shooting is required, the shooter needs to be shooting from the most beneficial and comfortable position.

In the past numerous gun supports have been invented and introduced to the market, including unipods, bipods and tripods. The gun supports utilizing tripods that were originally designed for photographic applications have been adapted with some success. The photographic tripods, equipped with any of a variety of tripod heads, typically have the ability to pan in a substantially horizontal plane, to tilt backward and forward and side-to-side, and to position vertically using a geared central crank column. Once suitably equipped, such tripods have specific characteristics adapted for the application described in each of the prior art examples set forth below.

One typical gun support for tripod mounting of the prior art is that of J. M. Mika et al., U.S. Pat. No. 6,272,785, which describes a gun support in the form of an elongated channel on a platform with an opening therethrough for the trigger portion of the gun. Such a mounting, while providing for a secure gun support, does not provide for an arm rest. Mika et al. '785 by its nature changes the environment of the trigger which affects the "feel" of the gun. Additionally the disclosure provides for the platform to be strapped to the gun, and thereby complicating disengagement from the support under field conditions.

Another tripod-mounted support is the sharpshooters rifle rest of J. G. Felts, U.S. Pat. No. 6,044,747. Here the primary focus is on the shooter rather than the rifle. Felts '747 provides the shooter with the requisite comfort through extensive armrests which along with rifle rests are attached to a mounting plate. The mounting plate, in turn, is tripod mounted and the assemblage creates a considerable array of gear to accompany the rifle into the field.

In Rather et al., U.S. Pat. No. 5,347,740, a rifle and camera mount is described having a multi-functional variable position mechanism similar to the tripod heads mentioned above. The prior art development of Rather et al. '740 brings together photography and hunting and enables the outdoorsman, on a case-by-case basis, to choose between the two. This device does not purport to physically support the shooter while awaiting the prey, but enables the shooter to capture by photography those other wildlife moments experienced during the wait.

The device of the present invention, as will be seen from the description which follows, overcomes the problems just described and exhibits the advantages provided hereinbelow.

SUMMARY OF THE INVENTION

A combined gun rest and armrest of the present invention includes an armrest which is attachable to a tripod. The armrest has a pair of elongated slots into which U-shaped gun rests are inserted and are laterally adjusted to support a gun. One of the gun rests is constructed to accommodate the forearm of the gun; and the other, the stock of the gun. The lateral adjustment of the gun rests enables the positioning thereof so as to have the center of gravity of the gun aligned with the tripod connection.

Upon placing the gun in the gun rests, the opening between the gun and the armrest enables the marksmen to assume the normal shooting position and provides unencumbered access to the trigger and the area surrounding the trigger. The device is constructed to be compatible with the normal physical range. However, in the cases outside the range, the gun rests may be raised or lowered accordingly. Once adjusted for a particular person and for a particular gun the settings are readily maintained for future use.

OBJECTS AND FEATURES OF THE INVENTION

An object of the present invention is to provide a combined gun rest and armrest which is suitable for tripod mounting and is economical to manufacture.

Another object of the invention is to provide a tripod-mounted gun rest and armrest which is readily adjustable and easy to use.

A feature of the present invention is the light weight thereof and that the gun is readily lifted from the support.

This together with other objects and advantages will become apparent in the description which follows.

BRIEF DESCRIPTION OF THE DRAWINGS

Throughout the drawings which follow, the same reference designators are used for the same parts.

DETAILED DESCRIPTION OF THE PREFERRED EMBODIMENT

Figure 1:
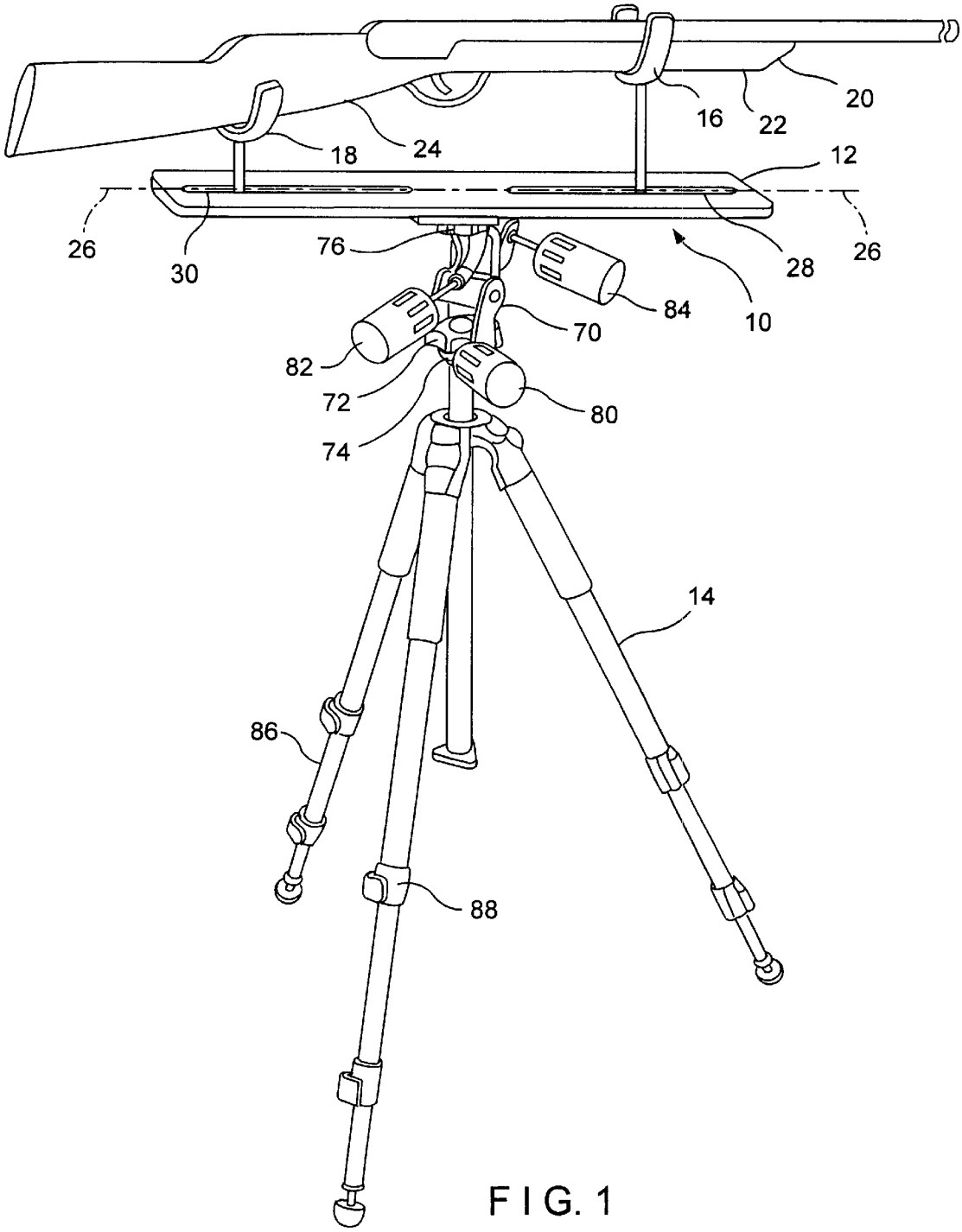
FIG. 1 is a perspective view of a combined gun rest and armrest device of the present invention shown mounted on a tripod equipped with a three-way tripod head.

The present invention relates to a combined gun rest and armrest for supporting a sport rifle or a sport gun and the arm of the shooter. The combined gun rest and armrest 10, FIG. 1, the invention includes an armrest or platform 12 adapted for mounting on a tripod 14. The armrest 12 is constructed to include a forward gun cradle 16 and a rearward gun cradle 18.

The forward gun cradle 16 and the rearward gun cradle 18 are adapted to support a gun 20. More specifically, the forward gun cradle 16 is adapted to support a gun forearm 22; and the rearward gun cradle 18 is adapted to support a gun butt 24. The cradle 16 and 18 support, but do not grip or encumber removal from the cradles. This enables a marksman to readily lift the gun from the cradles without an elaborate disengagement procedure. Each of the cradles are adjustably mounted in precision adjustment slots longitudinally disposed in arm rest 12. Arm rest 12 is an elongated body with a longitudinal axis 26 therethrough. The forward adjustment slot 28, coaxial with axis 26, is constructed to accommodate the mounting hardware associated with forward gun cradle 16 as described in detail hereinbelow. The rearward adjustment slot 30, coaxial with axis 26, is constructed to accommodate the mounting hardware associated with rearward gun cradle 18 as described in detail hereinbelow. The slots 28 and 30 allow the forward/rearward positioning of the gun 20 so that the center of gravity thereof is approximately over the center of the tripod 14.

Figure 2:
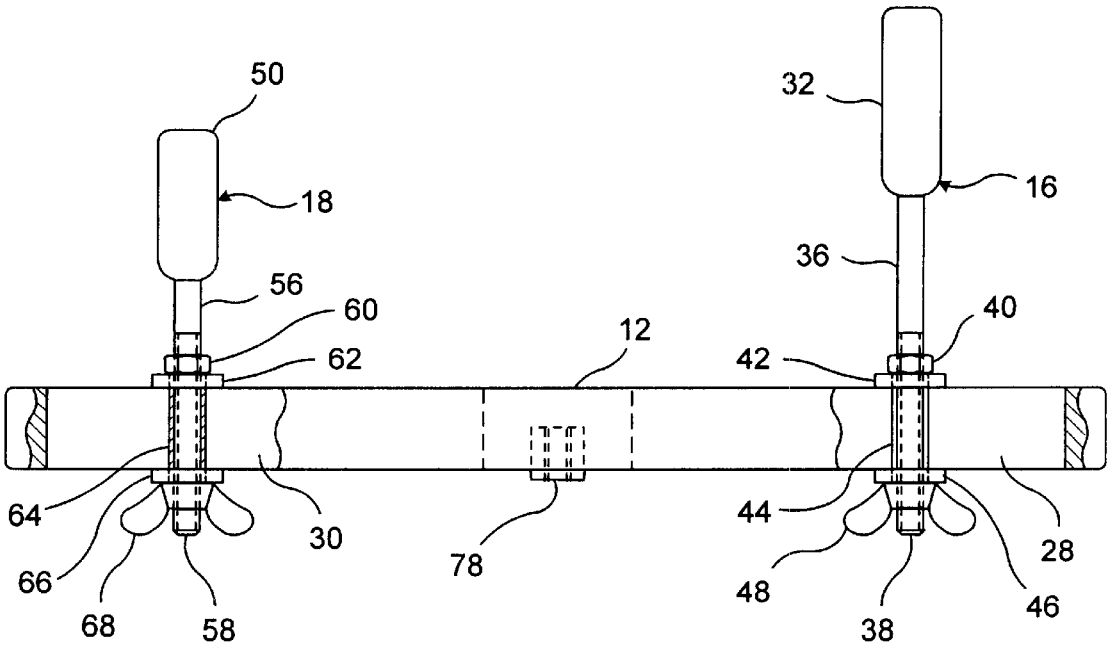
FIG. 2 is a side elevational view, partially broken away of the combined gun rest and armrest device of FIG. 1.
Figure 3:
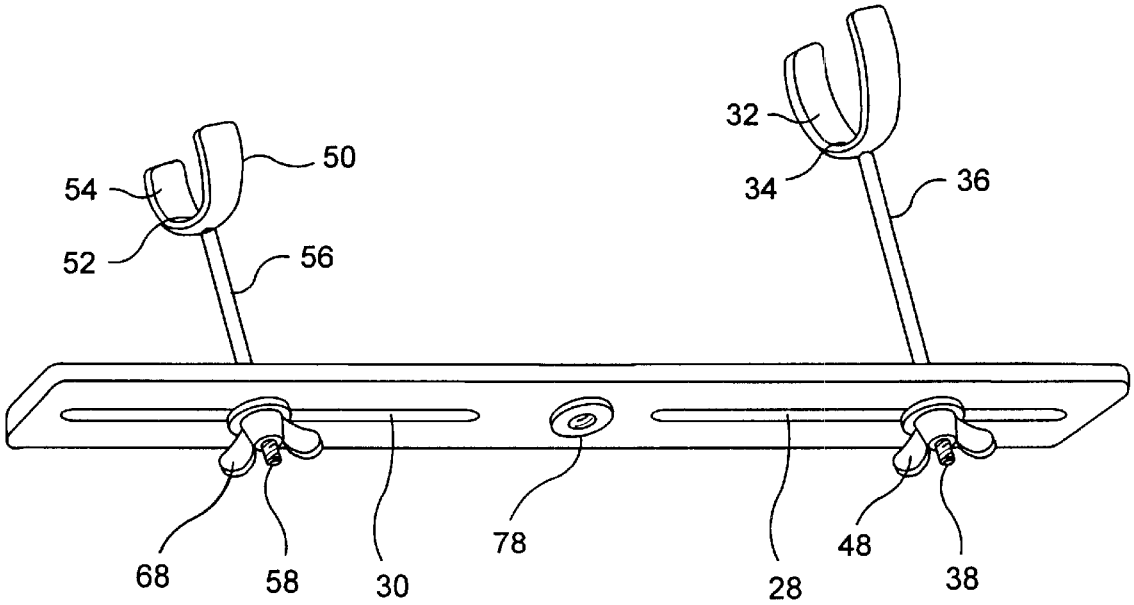
FIG. 3 is a perspective view from below of the combined gun rest and armrest device of FIG. 1; and, FIG. 4 is a perspective view of a combined gun rest and armrest device, similar to FIG. 1, but shown with a marksman supported by the armrest.

The forward or gun forearm cradle assembly 16 is shown in greater detail in FIGS. 2 and 3. The forearm cradle assembly has a U-shaped bracket 32 with the inner base thereof contoured to be compatible with the gun forearm. The bracket is coated or lined with a lining material 34 constructed to protect the finish of the gun, especially that of the gun forearm which is in contact with the cradle. To assure the accuracy of the mounting, the lining materials selected are preferably nonresilient so that the gun 20 does not, over time, increasingly compress a cushion-like support. Depending from the lower part of bracket 32 is a stem 36, the lower portion 38 of which is threaded. At an appropriate height, which is adequate for the forearm of the shooter to be beneath the gun 20 in the gun rest 10, a stopnut 40 and a washer 42 is attached. Adjacent washer 42 is a sleeve 44 dimensioned to fit slidingly within forward adjustment slot 28. Optionally, the sleeve 44 is constructed from a compressible, expandable material so that when tightened locks against the sides of slot 28. The cradle assembly 16 is completed with lockwasher 46 and wingnut 48. The forward cradle assembly 16 is constructed to be adjustable for the comfort of the shooter so that the cradle is raised or lowered accordingly and to be adjustable forward and back to accommodate the gun of choice.

The rearward or gun butt cradle assembly 18 is shown in greater detail in FIGS. 2 and 3. The butt cradle assembly, like the forearm cradle assembly 16, has a U-shaped bracket 50 contoured to accommodate the butt of the gun with the floor 52 of the bracket 50 sloping upwardly (from rear to front). The bracket 50 is coated with a lining material 54 for the purpose of protecting the finish of gun 20. Depending from the butt bracket 50 is the stem 56, the lower portion 58 of which is threaded. The butt cradle 18 is mounted at an appropriate height so that a gun 20 resting in the two brackets just described will have the barrel supported substantially parallel to arm rest 12. For mounting purposes, a stopnut 60 and a washer 62 are attached to stem 56 and similar to the above, a sleeve 64, lockwasher 66 and wingnut 68 complete the An mounting hardware. The rearward cradle assembly 18 is constructed to be adjustable in rearward adjustment slot 30 as described above. Once a gun owner adjusts the combined gun rest and armrest 10 to his own physique and to the dimensional characteristics of the gun 20, the adjustment settings can thereafter be readily maintained.

The tripod 14, FIG. 1, is a conventional photographic tripod such as Model 3021, or equivalent, manufactured by Lino Manfrotto & Co., S.p.A., Bassano del Grappo, Italy, and distributed in the United States of America by Bogen Photo Corp., Ramsey, N.J., and equipped with a three-way head 70 such as Model 3029, or equivalent. The tripod 14 is attached by a standard ⅜-inch male screw 72 to a ⅜-inch female fitting 74 of the head 70. The three-way head 70 is, in turn, attached to the armrest 12 by a standard ¼-20 male screw to a ¼-inch female fitting 78 of the armrest 12. The three-way head 70 is constructed to control the panning in a substantially horizontal plane and is locked in position using pan control 80. Also, the three-way head 70 is constructed to control the tilting in a forward-and-back movement and is locked in position using tilt control 82. Similarly, the three-way head 70 is constructed to control the levelling by a side-to-side movement and is locked in position using level control 84. In this manner three axis movement is controlled with separate locking handles for each axis. The legs 86 of tripod 14 are constructed with quick-action lever leg locks 88.

Figure 4:
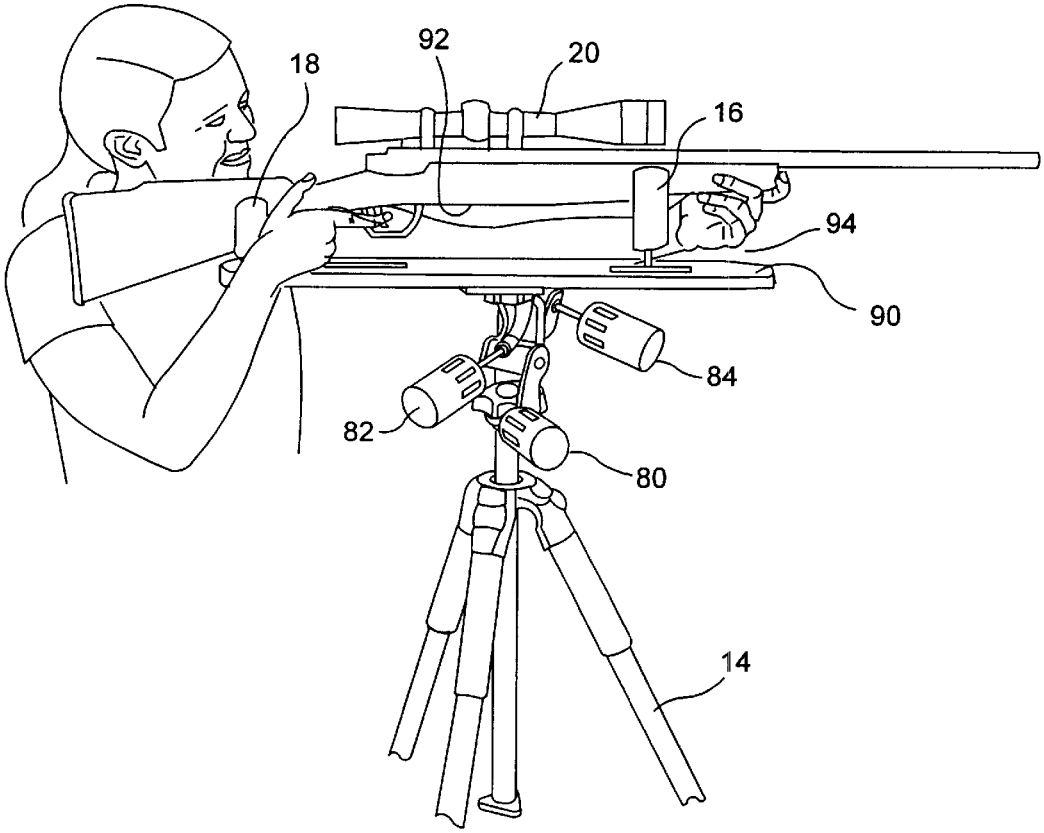

Referring now to FIG. 4, the operation of the combined gunrest and armrest for supporting a rifle and the arm of the shooter is next described. FIG. 4 shows a marksman positioned at-the-ready. The arm of the shooter is supported by surface 90 of armrest 12. It is noted that the hand of the shooter (of the supported arm) is draped about gun forearm 22 which, in turn, is supported by gun cradle 16. The hand of the shooter (of the unsupported arm) is positioned below gun butt 24 which, in turn, is supported by gun cradle 18 and this hand rests on surface 90 at the gun trigger site. Further, with adjustment of the cradles 16 and 18, the precise lower surface 92 of rifle 20 is positionable to provide an aperture 94 between surfaces 90 and 92 that accommodates the physique of the marksman.

The invention disclosed hereby is presented as a unique, tripod-mountable combined gun rest and armrest device which is readily adjustable and adaptable. Thus, the appended claims are to be interpreted broadly, as it is understood that slight variations can be made in the device without departing from the spirit of this invention.

What is claimed is:

1. A tripod-mountable combined gun rest and armrest device for holding a gun and supporting the arm of a marksman, said device comprising:

an elongated armrest having a longitudinal axis therethrough, said armrest attachable to a tripod;

a forward gun rest having a U-shaped configuration adjustably mounted on said armrest, wherein the armrest has a longitudinally extending forward adjustment slot therethrough along said longitudinal axis;

gun forearm positioner for selective lateral positioning of said forward gun rest along said forward slot to receive a forearm of said gun;

a rearward gun rest having a U-shaped configuration adjustably mounted on said armrest, wherein the armrest has a longitudinally extending rearward adjustment slot therethrough along said longitudinal axis;

gun butt positioner for selective lateral positioning of said rearward gun rest laterally along said forward slot to receive a butt of said gun;

said gun rest adapted, upon placement of said gun on said forward gun rest and said rearward gun rest, to form an opening between said gun and an upper surface of said armrest dimensioned to support the arm of the marksman in the shooting position.

2. A combined gun rest and armrest device as described in claim 1, wherein said device further comprises:

a tripod connector in a lower surface of said armrest on said longitudinal axis medially between said forward adjustment slot and said rearward adjustment slot.

3. A combined gun rest and armrest device as described in claim 2, wherein said forward gun rest further comprises:

a forward gun rest stem attached to and depending from said U-shaped configuration and, when mounted to said armrest, dimensioned to fit snugly within said forward adjustment slot thereof;

a locking nut securing said forward gun rest to said armrest, and, upon release thereof, permitting positioning of said forward gun rest back and forth along said forward adjustment slot.

4. A combined gun rest and armrest device as described in claim 2, wherein said rearward gun rest further comprises:

a rearward gun rest stem attached to and depending from said U-shaped configuration and, when mounted to said armrest dimensioned to fit snugly within said rearward adjustment slot thereof;

a locking nut securing said rearward gun rest to said armrest, and, upon release thereof, permitting positioning of said rearward gun rest back and forth along said rearward adjustment slot.

5. A combined gun rest and armrest device as described in claim 2, further comprising:

a forward gun rest stem attached to and depending from said U-shaped configuration and, when mounted to said armrest, dimensioned to fit snugly within said forward adjustment slot thereof;

a locking nut securing said forward gun rest t said armrest, and, upon release thereof, permitting positioning of said forward gun rest back and forth along said forward adjustment slot.

a rearward gun rest stem attached to and depending from said U-shaped configuration and, when mounted to said armrest, dimensioned to fit snugly within said rearward adjustment slot thereof;

a locking nut securing said gun rest to said armrest, and, upon release thereof, permitting positioning of said rearward gun rest back and forth along said rearward adjustment slot.

6. A combined gun rest and armrest device as described in claim 5, wherein said forward gun rest and said rearward gun rest are adjustably positioned to support the gun with the center of gravity thereof over said tripod connector.

7. A combined gun rest and armrest device as described in claim 3, wherein said forward gun rest stem further comprises:

a first sleeve over said forward gun rest stem of resilient material expandable upon tightening said locking nut and thereupon locking said forward gun rest against said forward adjustment slot.

8. A combined gun rest and armrest device as described in claim 4, a second sleeve over said rearward gun rest stem of resilient material expandable upon tightening said locking nut and thereupon locking said rearward gun rest against said rearward adjustment slot.

* * * * *